US006960728B1

(12) United States Patent
Halderman

(10) Patent No.: US 6,960,728 B1
(45) Date of Patent: Nov. 1, 2005

(54) ELECTRIC FENCE WIRE INSULATOR FOR A METAL FENCE POST

(76) Inventor: G. Alan Halderman, 310 S. Main St., Eldorado, OH (US) 45321

( * ) Notice: Subject to any disclaimer, the term of this patent is extended or adjusted under 35 U.S.C. 154(b) by 32 days.

(21) Appl. No.: 11/046,103

(22) Filed: Jan. 28, 2005

(51) Int. Cl.[7] ..... H01B 17/16

(52) U.S. Cl. ..... 174/158 F; 174/160; 174/161 R; 174/161 F; 174/163 F; 256/47

(58) Field of Search ..... 174/158 F, 159, 174/160, 161 R, 161 F, 162, 163 R, 163 F, 174/164, 165, 166 R; 256/10, 47, 50

(56) References Cited

U.S. PATENT DOCUMENTS

| | | | | | |
|---|---|---|---|---|---|
| 2,537,719 | A | * | 1/1951 | Tuepker | 174/163 F |
| 2,896,011 | A | * | 7/1959 | Huseby | 174/163 F |
| 3,733,429 | A | * | 5/1973 | Berg et al. | 174/161 F |
| 3,820,758 | A | * | 6/1974 | Berg, Jr. et al. | 174/163 F |
| 4,049,905 | A | | 9/1977 | Maranell | |
| 4,077,611 | A | | 3/1978 | Wilson | |
| 4,623,756 | A | | 11/1986 | Wilson, Jr. | |
| 4,845,317 | A | | 7/1989 | Wilson, Jr. | |
| 5,085,409 | A | * | 2/1992 | Teixeira | 174/158 F |
| 6,353,187 | B1 | | 3/2002 | Wilson, Jr. | |
| 6,824,122 | B2 | * | 11/2004 | Spyrakis | 256/47 |

FOREIGN PATENT DOCUMENTS

| | | | | |
|---|---|---|---|---|
| GB | 218771 | A * | 9/1987 | E04H 17/00 |

* cited by examiner

*Primary Examiner*—Chau N. Nguyen
*Assistant Examiner*—Adolfo Nino
(74) *Attorney, Agent, or Firm*—Jacox, Meckstroth & Jenkins

(57) ABSTRACT

An electric wire fence insulator has a molded plastic body including a post mounting portion surrounding and slidably receiving a vertical T-type metal fence post having vertically spaced projections. The molded body also includes a wire support portion having vertically spaced ears for receiving an electric fence wire, and two lock pins may be integrally molded with the body and may be connected to the body by flexible and twistable link portions of the plastics material. One lock pin extends into a horizontal hole within the mounting portion and between adjacent projections on the post, and the other lock pin extends into a vertical hole within the ears of the wire support portion. The body may include an elongated horizontal arm portion which integrally connects the mounting portion to the wire support portion.

20 Claims, 3 Drawing Sheets

47'
22'
20'
15'
18'
48'
66
44'
72
39'
64
66
43'
38'
52'
54'
46'

47'
15'
22'
20'
18'
48'
66

44'
54'
64
66
38'
52'
46'
43'
36'

47'
15
48'
29

64
66
68
44'
25
18'
54'
38'
46'
32
27
66
31
36'
52'

ELECTRIC FENCE WIRE INSULATOR FOR A METAL FENCE POST

BACKGROUND OF THE INVENTION

This invention relates to electrical insulators for electric fence wires and which are commonly mounted on vertical metal fence posts, for example, of the general type disclosed in U.S. Pat. Nos. 4,049,905, 4,077,611, 4,845,317 and 6,353,187, the disclosures of which are herein incorporated by reference. As disclosed in these patents, the insulator is commonly molded of an insulating plastics material and is adapted to be attached to a conventional T-type metal fence post at a selected vertical height or elevation according to the desired position of the electric fence wire. It is also common to mount two or more of the insulators on each fence post when it is desired to have vertically spaced electric fence wires.

In any such insulator, it is desirable for the insulator to mount quickly and positively on the fence post so that the insulator cannot be pulled off or slide or shift vertically on the post after it has been installed. It has also been found desirable to avoid relying on the flexibility of the molded plastics material in the portion of the insulator which mounts on or grips the metal fence post. If the spring property of the plastics material relaxes, the insulator may pop off or slide down the post, thereby allowing electric fence wire to sag and/or short out by contacting the fence post. It is also sometimes desirable to space the electric fence wire from the post to avoid grounding of the wire and to facilitate mowing of weeds directly under the wire so as to prevent an electrical short by the weeds.

SUMMARY OF THE INVENTION

The present invention is directed to an improved electric fence wire insulator which provides all of the desirable advantages mentioned above and which may be easily and quickly mounted and positioned on a metal fence post and then positively locked to the fence post at a selected vertical position or elevation. The insulator of the invention also has high strength and durability, is convenient to use and economical in production.

In accordance with one embodiment of the invention, an electric fence wire insulator includes a body of molded plastic material, and the body has a mounting portion defining the vertically extending opening having generally a T-shaped cross-sectional configuration. The opening includes a vertical channel and slidably receives a conventional metal fence post having a similar configuration and longitudinally or vertically spaced lugs or projections. The body also includes a projecting electric fence wire support portion which is integrally molded with the mounting portion and has vertically spaced flanges or ears for receiving an electric fence wire therebetween. A horizontal hole is formed in the mounting portion adjacent the channel, and a lock pin extends or projects into the hole between adjacent projections on the fence post to lock the insulator at a desired elevation on the fence post. The ears of the wire support portion have vertically aligned holes for also receiving another lock pin which positively secures the electric fence wire to the insulator.

In a modification, both of the lock pins are integrally connected to the body of the insulator by flexible and twistable link elements so that the lock pins always remain with the insulator body and are simultaneously molded with the body for economical production. In another modification, the wire support portion of the insulator is integrally connected to the mounting portion by an elongated horizontal arm portion molded of the same plastics material. The arm portion provides for spacing the electrical fence wire at a predetermined horizontal distance from the supporting metal post.

Other features and advantages of the invention will be apparent from the following description, the accompanying drawings and the appended claims.

DESCRIPTION OF THE PREFERRED EMBODIMENTS

Figure 1:
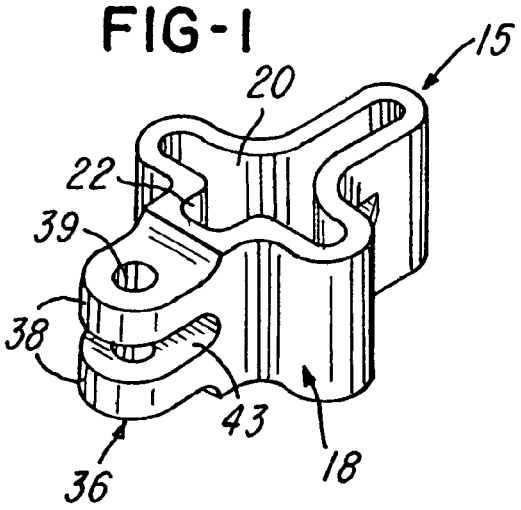
FIG. 1 is a perspective view of an electric fence wire insulator constructed in accordance with one embodiment of the invention.
Figure 2:
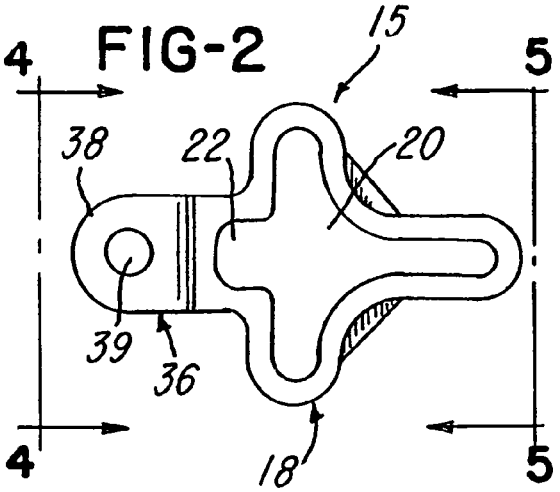
FIG. 2 is a top view of the insulator shown in FIG. 1.
Figure 3:
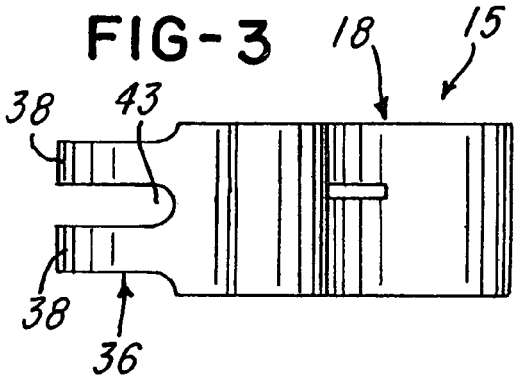
FIG. 3 is a side view of the insulator shown in FIG. 1.

FIGS. 1–5 illustrate an electric fence wire insulator 15 having a body which is preferably molded of an electrical insulating plastics material such as polypropylene. The body includes a post mounting portion 18 having a generally uniform wall thickness and defining generally a T-shaped vertical opening 20 with a vertically extending groove or channel 22. The opening 20 and channel 22 are sized and configured to receive a conventional metal fence post such as an installed vertical post 25 shown in FIG. 11. This form of forged metal fence post has generally a T-shaped cross-sectional configuration formed by a rib portion 27 and oppositely projecting flange portions 29. The post 25 also includes a rib portion 31 from which projects longitudinally or vertically spaced lugs or projections 32, for example, as disclosed in U.S. Pat. No. 4,623,756, the disclosure of which is incorporated by reference.

Figure 4:
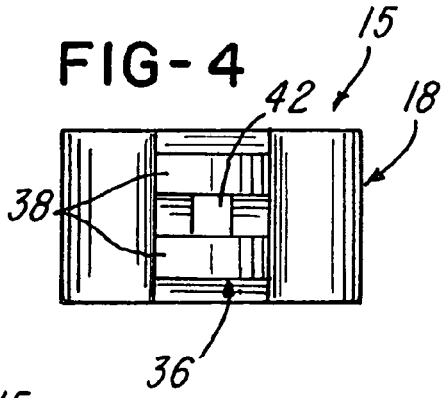
FIG. 4 is an end view of the insulator taken on the line 4—4 of FIG. 2.
Figure 5:
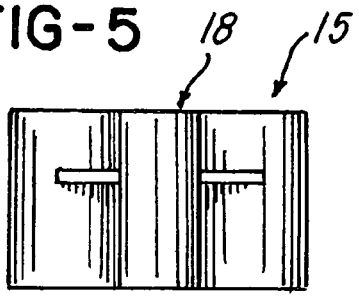
FIG. 5 is an end view of the insulator taken on the line 5—5 of FIG. 2.

The molded body of the insulator 15 also includes an electric fence wire support portion 36 (FIGS. 1–4) which is molded integrally with the mounting portion 18 and includes vertically spaced ears 38 having vertically extending aligned holes 39. Referring to FIG. 4, a square opening or hole 42 is formed within the mounting portion 18 of the body and extends from the gap or space 43 between the ears 38 to the channel 22.

Figure 6:
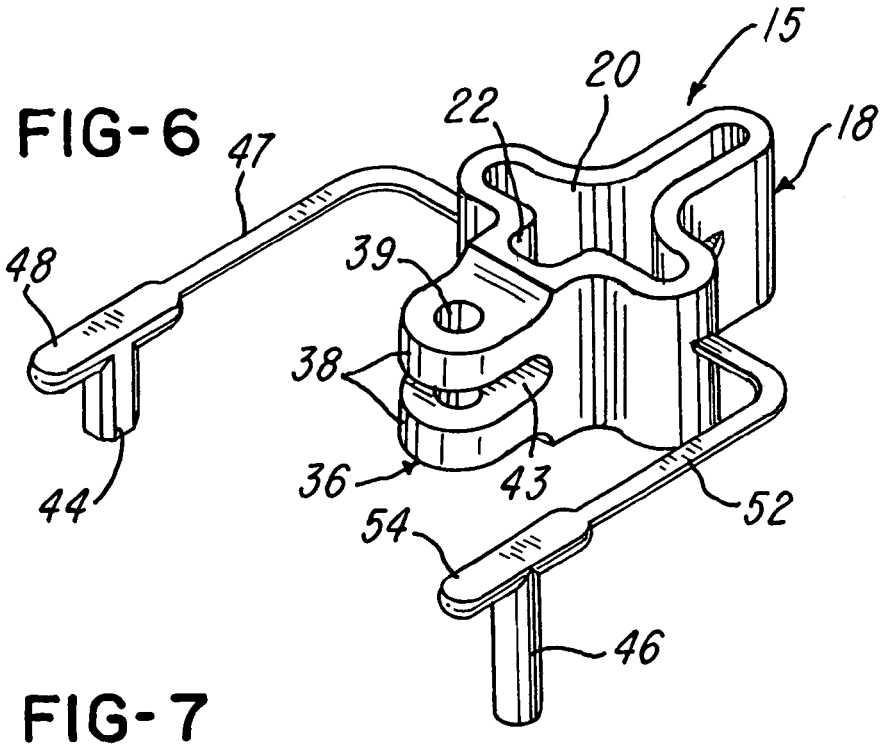
FIG. 6 is a perspective view of a second embodiment of an electric fence wire insulator constructed in accordance with the invention.
Figure 7:
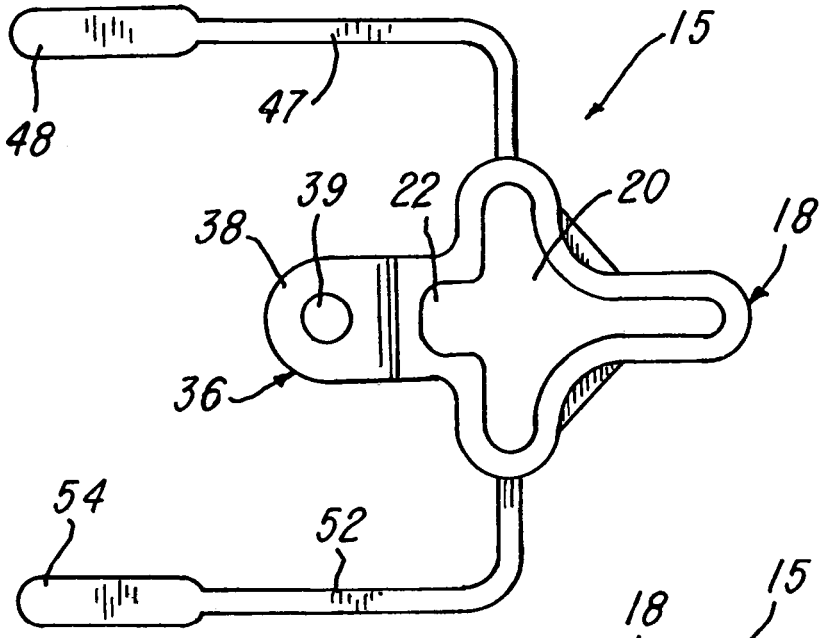
FIG. 7 is a top view of the insulator shown in FIG. 6.
Figure 8:
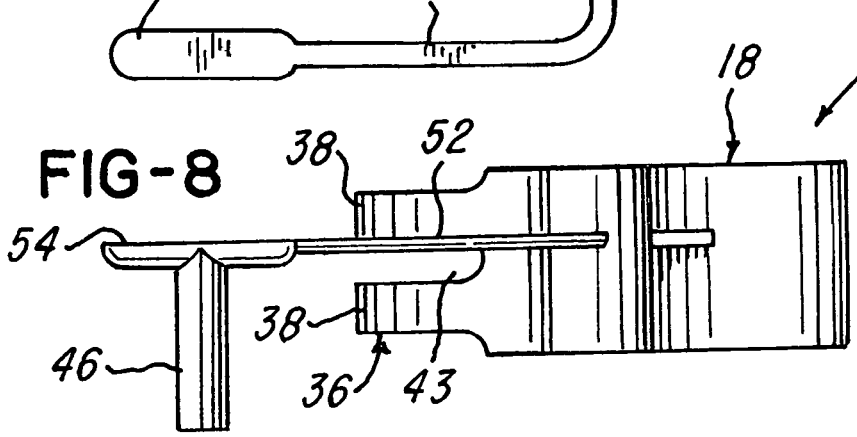
FIG. 8 is a side view of the insulator shown in FIG. 6.

Referring to FIGS. 6–8, a generally square lock pin 44 and a cylindrical lock pin 46 may be integrally molded with the body of the insulator 15. A flexible and twistable L-shaped link element 47 integrally connects the body of the insulator 15 to a head portion 48 for the lock pin 44, and a flexible and twistable L-shaped link element 52 integrally connects the body of the insulator 15 to a head portion 54 for the lock pin 46. While the lock pins 44 and 46 and the corresponding head portions 48 and 54 may be molded separately from the body of the insulator 15, it is preferred that the lock pins 44 and 46 and their corresponding head portions 48 and 54 be integrally and simultaneously molded with the body of the insulator 15 by means of the flexible and twistable link elements 47 and 52. This assures that the lock pins 44 and 46 remain with the insulator during handling, transporting, installing and use of the insulator.

After the mounting portion 18 of the insulator 15 is installed on a vertical metal fence post 25 by sliding the mounting portion 18 downwardly on the post, and the insulator 15 is positioned at the desired location or elevation on the post. The lock pin 44 is then inserted laterally or horizontally into the opening 42 until the inner end portion of the lock pin 44 extends inwardly between two adjacent studs or projections 32 and engages the fence post 25. The insulator 15 is thereby locked to the fence post and prevented from sliding or shifting vertically or downwardly on the fence post. After a horizontal electric fence wire (not shown) is inserted into the slot or gap 43 between the ears 38 of the wire support portion 36, the lock pin 46 is pressed downwardly into the holes 39 within the ears 38, thereby positively locking the electric fence wire to the insulator 15.

Figure 9:
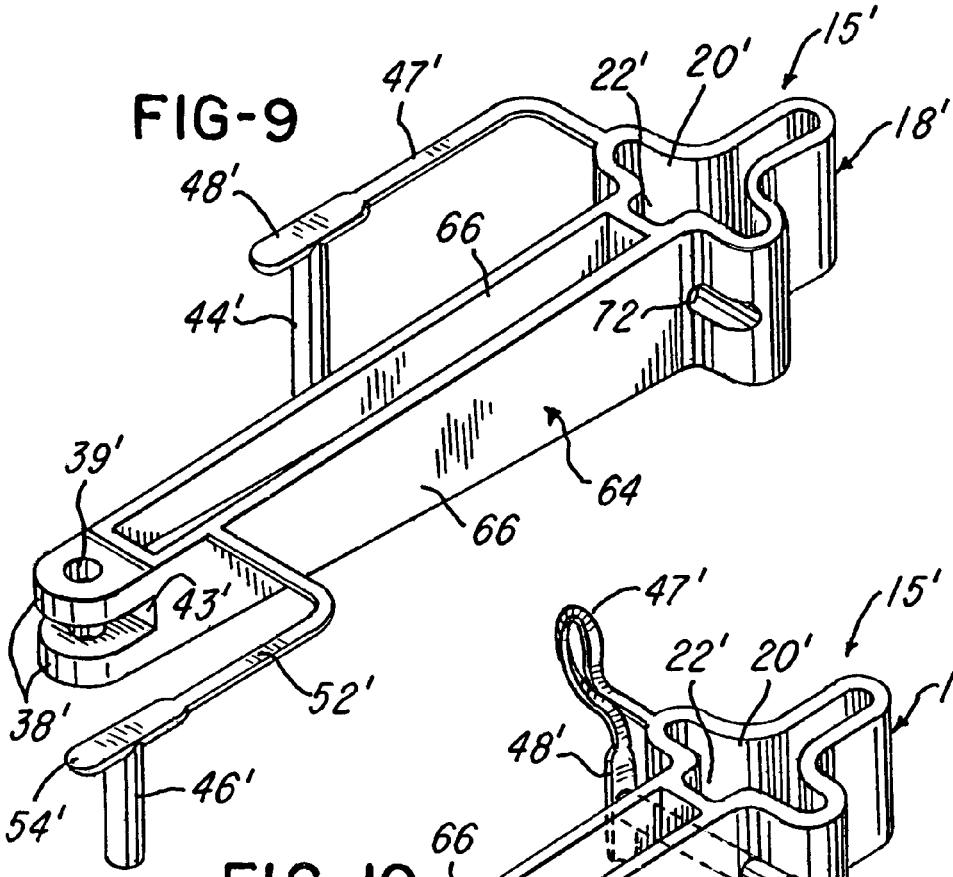
FIG. 9 is a perspective view of a third embodiment of an electric fence wire insulator constructed in accordance with the invention.
Figure 10:
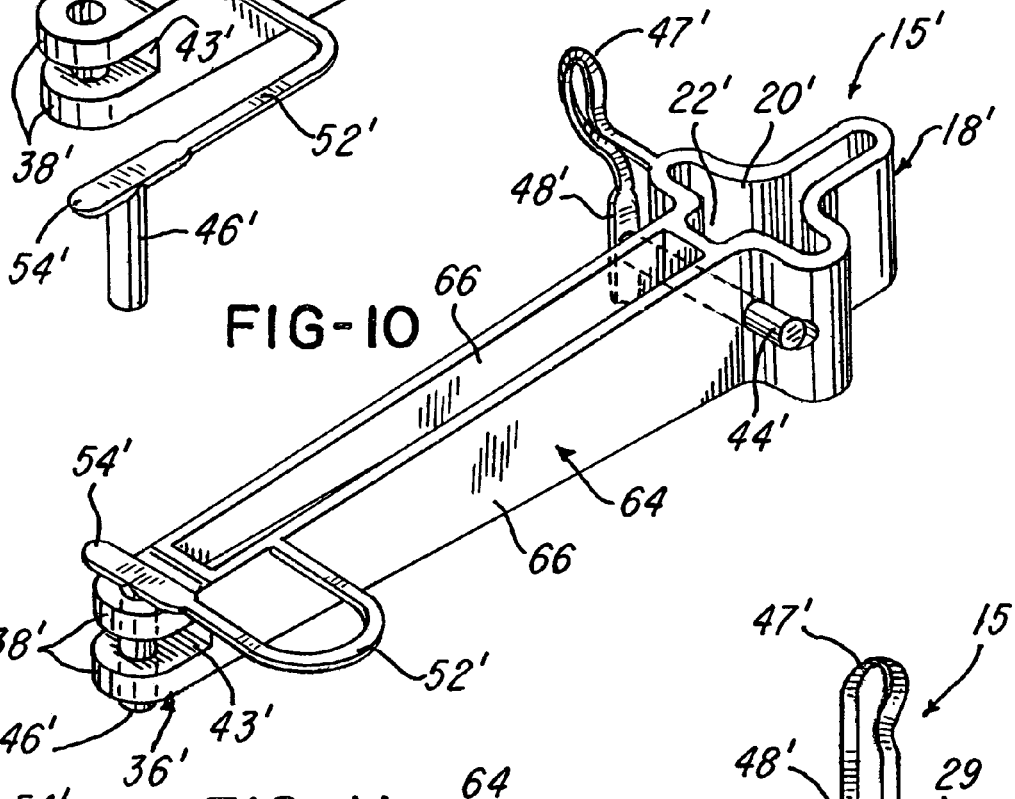
FIG. 10 is another perspective view of the insulator shown in FIG. 9 and with the two lock pins inserted.
Figure 11:
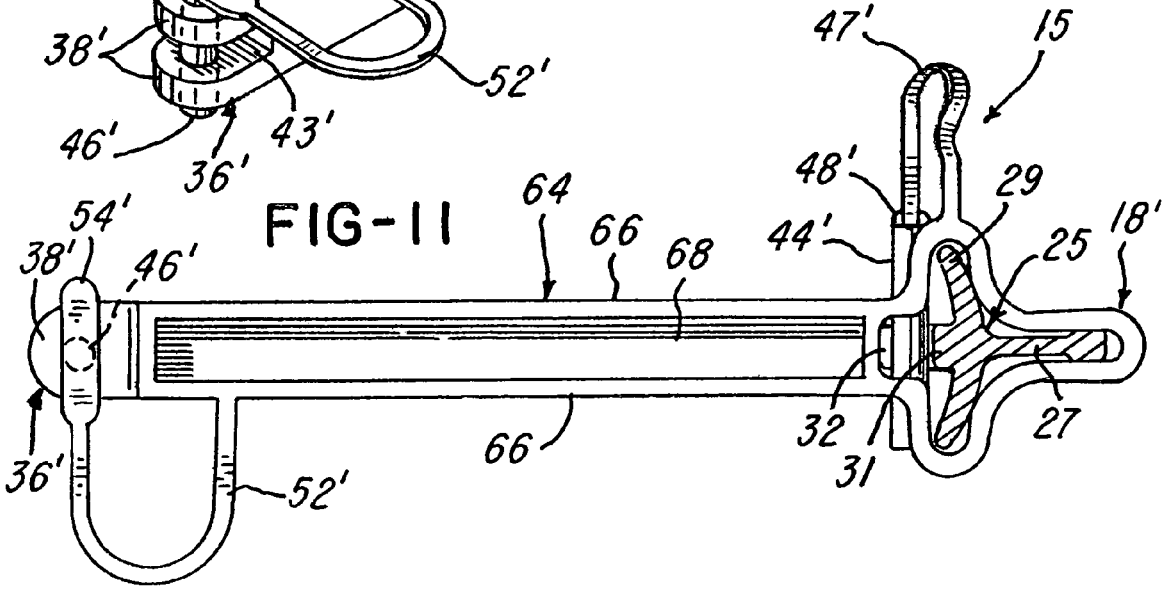
FIG. 11 is a top view of the insulator shown in FIG. 10 and mounted on a vertical metal fence post shown in section.

FIGS. 9–11 illustrate a modification or another embodiment of an electric fence wire insulator constructed in accordance with the invention and which has similar construction and similar components as the embodiments disclosed above in connection with FIGS. 1–8. Accordingly, the same reference numbers are used to identify common and similar structure or components, but with the addition of prime marks. Thus an electric wire insulator 15' includes a molded plastic body having a mounting portion 18' and an electric wire support portion 36' which are integrally connected by an elongated horizontal arm portion 64. The arm portion has an H-shape cross-sectional configuration formed by parallel spaced side walls 66 integrally connected by an intermediate web or wall 68. In this embodiment, the lock pin 46' and head portion 54' are integrally connected by a flexible and twistable link element 52' to a side wall 66 of the arm portion 64. Also in this embodiment, a lock pin 44' is cylindrical and longer than the lock pin 44 and is integrally connected to the top end of the mounting portion 18' by the head portion 48' and a flexible and twistable link element 47'. Horizontally extending and aligned cylindrical openings or holes 72 are formed within the mounting portion 18' and interrupt the channel 22'.

After the insulator 15' is slid downwardly on an installed vertical fence post 25 to the desired elevation, the lock pin 44' is inserted into the aligned holes 72 and between a pair of adjacent projections 32 of the fence post 25, as shown in FIG. 11, to lock the insulator 15' onto the fence post. Then after the electric fence wire (not shown) is inserted into the gap or slot 43' between the ears 38' of the support portion 36', the pin 46' is inserted or pressed downwardly into the vertically aligned holes 39' within the ears 38' to lock the fence wire within the support portion 36'. As apparent, the elongated horizontal arm portion 64 of the insulator 15' provides for supporting the electric fence wire a substantial predetermined distance from the metal fence post 25. This is sometimes desirable to avoid any possibility of the electric fence wire being grounded and sometimes to permit convenient and continuous mowing of weeds directly under the fence wire so that the weeds do not short out the fence wire.

From the drawings and the above description, it is apparent that an electric fence wire insulator constructed in accordance with the invention provides desirable features and advantages. As one advantage, the mounting portion 18 or 18' closely surrounds the metal fence post 25 and provides a high strength and rigid connection while permitting the insulator to be slid or shifted vertically on the fence post to the desired elevation for the fence wire. After the desired elevation is selected, the lock pin 44 or 44' is inserted and positively secures the insulator to the fence post at the selected elevation. When it is desired to change the elevation of the insulator 15 or 15' on a fence post or remove the insulator from the post, the lock pin 44 or 44' is simply retracted or removed, and the insulator may be moved vertically on the fence post. Similarly, after the electric fence wire is inserted between the ears 38 or 38', the wire is positively locked to the insulator by inserting the lock pin 46 or 46' into the aligned holes 39 or 39' of the wire support portion 36 or 36'. The insulator 15 or 15' may also be conveniently molded, and the integrally connected lock pins assure that the lock pins remain with the insulator at all times during handling, storage, shipping and use.

While the forms of insulator herein described constitute preferred embodiments of the invention, it is to be understood that the invention is not limited to these precise forms, and that changes may be made therein without departing from the scope and spirit of the invention as defined in the appended claims.

What is claimed is:

1. An electric fence wire insulator in combination with a vertical metal fence post having vertically spaced projections, said insulator comprising a body of molded electrical insulating material and including a mounting portion defining an opening receiving said fence post, said opening providing for sliding said body vertically on said fence post past said projections, said body also including a wire support portion adapted to receive and support an electric fence wire, and a lock member supported by said body and moveable relative to said body between a released position and a locked position extending between adjacent said projections for positively securing said body at a selected vertical position on said fence post.

2. An insulator as defined in claim 1 wherein said mounting portion of said body surrounds said opening and has a generally uniform wall thickness, and said opening and said fence post each has generally a T-shaped cross-sectional configuration.

3. An insulator as defined in claim 1 wherein said lock member comprises a lock pin supported for generally horizontal movement within a hole in said body between said released and locked positions.

4. An insulator as defined in claim 1 wherein said lock member is integrally connected to said body by a flexible link portion of said material.

5. An insulator as defined in claim 1 wherein said wire support portion of said body comprises vertically spaced ears having substantially vertically aligned holes, and a lock pin extending into said holes.

6. An insulator as defined in claim 5 wherein said lock pin is integrally connected to said body by a flexible link portion of said material.

7. An insulator as defined in claim 1 wherein said body comprises a horizontally extending elongated arm portion integrally connecting said wire support portion to said mounting portion for positioning the fence wire at a predetermined horizontal distance from said fence post.

8. An insulator as defined in claim 7 wherein said arm portion has an H-shaped vertical cross-sectional configuration.

9. An insulator as defined in claim 1 wherein said vertical fence post includes a vertical rib portion with laterally projecting opposite vertical flange portions providing said post with generally a T-shape cross-sectional configuration, and said lock member comprises an elongated lock pin extending through a hole within said body generally parallel to said flange portions of said post and between adjacent said projections.

10. An insulator as defined in claim 1 wherein said body defines a vertical channel extending from said opening for receiving said projections in response to vertically sliding movement of said body on said post, said body defines a hole extending generally horizontally into said channel, and said lock member comprises a releasable lock pin projecting into said hole.

11. An insulator as defined in claim 10 wherein said lock pin is integrally connected to said body by a flexible and twistable link portion of said material.

12. An electric fence wire insulator in combination with a vertical metal fence post having vertically spaced projections, said insulator comprising a body of molded electrical insulating material and including a mounting portion defining an opening receiving said fence post with said mounting portion surrounding said fence post, said opening providing for sliding said body vertically on said fence post past said projections, said body also including a wire support portion adapted to receive and support an electric fence wire, a removable lock pin extending into a hole within said body and extending between adjacent said projections for positively securing said body at a selected vertical position on said fence post.

13. An insulator as defined in claim 12 wherein said mounting portion of said body has a generally uniform wall thickness, and said opening and said fence post each has generally a T-shaped cross-sectional configuration.

14. An insulator as defined in claim 12 wherein said lock pin is integrally connected to said body by a flexible link portion of said material.

15. An insulator as defined in claim 12 wherein said wire support portion of said body comprises vertically spaced ears having substantially vertically aligned holes, and a second lock pin extending into said holes.

16. An insulator as defined in claim 15 wherein said second lock pin is integrally connected to said body by a flexible link portion of said material.

17. An insulator as defined in claim 12 wherein said body comprises a horizontally extending elongated arm portion integrally connecting said wire support portion to said mounting portion for positioning the fence wire at a predetermined horizontal distance from said fence post.

18. An insulator as defined in claim 12 wherein said vertical fence post includes a vertical rib portion with laterally projecting opposite vertical flange portions providing said post with generally a T-shape cross-sectional configuration, and said lock pin extends through a generally horizontal hole within said body generally parallel to said flange portions of said post and between adjacent said projections.

19. An insulator as defined in claim 12 wherein said body defines a vertical channel extending from said opening for receiving said projections in response to vertically sliding movement of said body on said post, said body defines a hole extending generally horizontally into said channel, said lock pin projects into said hole, and said lock pin is integrally connected to said body by a flexible and twistable link portion of said material.

20. An electric fence wire insulator in combination with a vertical metal fence post, said insulator comprising a body of molded electrical insulating material and including a mounting portion defining an opening receiving said fence post with said mounting portion surrounding said fence post, said opening providing for sliding said body vertically on said fence post, said body also including a wire support portion adapted to receive and support an electric fence wire, a removable lock pin supported by said body and extending into a hole within said body to engage said fence post for positively securing said body at a selected vertical position on said fence post, and a flexible link portion of said material integrally connecting said lock pin to said body.

* * * * *